US006135084A

United States Patent [19]

Cornéer

[11] Patent Number: 6,135,084

[45] Date of Patent: Oct. 24, 2000

[54] DEVICE FOR INTEGRATED INJECTION AND IGNITION IN AN INTERNAL COMBUSTION ENGINE

[76] Inventor: Sven Cornéer, Karlavägen 18, s-114 31 Stockholm, Sweden

[21] Appl. No.: 09/029,668

[22] PCT Filed: Jul. 8, 1997

[86] PCT No.: PCT/SE97/01244

§ 371 Date: May 4, 1998

§ 102(e) Date: May 4, 1998

[87] PCT Pub. No.: WO98/01666

PCT Pub. Date: Jan. 15, 1998

[30] Foreign Application Priority Data

Jul. 8, 1996 [SE] Sweden ..... 9602704
Aug. 23, 1996 [SE] Sweden ..... 9603080

[51] Int. Cl.[7] ..... F02B 19/12; F02B 19/18

[52] U.S. Cl. ..... 123/259; 123/260; 123/267; 123/286

[58] Field of Search ..... 123/259, 260, 123/266, 267, 273, 286

[56] References Cited

U.S. PATENT DOCUMENTS 1,392,364 10/1921 Smith ..... 123/267 X
3,073,289 1/1963 Candelise ..... 123/266 X
3,661,125 5/1972 Stumpfig ..... 123/267 X
4,006,725 2/1977 Baczek et al. ..... 123/267
4,433,660 2/1984 Blaser ..... 123/266
4,967,708 11/1990 Linder et al. ..... 123/297
5,497,744 3/1996 Nagaosa et al. ..... 123/297

FOREIGN PATENT DOCUMENTS 580 477 11/1946 United Kingdom .

*Primary Examiner*—Tony M. Argenbright
*Attorney, Agent, or Firm*—Renner, Otto, Boisselle & Sklar, P. L. L.

[57] ABSTRACT

The invention relates to a device for integrated injection and ignition of fuel in internal combustion engines, particularly Otto engines with separate fuel ignition. The device includes an integrated injection module (14) and ignition module (6). The ignition module includes a body that can be attached to the top of the engine and that has an internal tubular shape the lower part of which merges with a conically shaped cavity (7) with the base open towards the engine combustion chamber (2), such that the conically shaped cavity (7) forms a supplementary smaller volume of the combustion chamber.

11 Claims, 5 Drawing Sheets

DEVICE FOR INTEGRATED INJECTION AND IGNITION IN AN INTERNAL COMBUSTION ENGINE

The present invention relates to a device for integrated fuel injection and fuel ignition in internal combustion engines, and particularly in Otto engines with separate fuel ignition.

Great efforts have been made to reduce fuel consumption and the emission of harmful combustion residues from the internal combustion engines of motor vehicles and in other applications. The development of electronics and computers in recent years has eased the path towards more effective engines, by enabling more precise proportioning of fuel, optimized ignition and monitoring of combustion.

The electronics of present-day engines have mainly been concentrated on reducing the proportion of fuel in the intake air and on increasing the proportion of air. The fuel is normally mixed with the intake air prior to being injected into the engine cylinder. It is also possible, however, to inject the fuel directly into the cylinder, as in the case of a diesel engine, subsequent to the intake air having filled the cylinder and the valves are closed. Mercedes Benz developed a functional direct injection petrol-driven car as early as the 1960s. Numerous alternative direct injection constructions have been developed in recent years, with a particular aim towards concentrating the directly injected fuel onto the spark plug.

Petrol-driven cars lack a number of the advantages afforded by a diesel engine, which can be filled continuously with free oxygen in air mixture. Neither do diesel engines have any form of throttle valve which on other types of internal combustion engines generate a vacuum as the engine draws in air, greatest when idling and thereafter decreasing. The throttle valve thus functions as a large inherent resistance at low power outputs and impairs the fuel economy of the engine.

Although more modern Otto engine injection systems approach the advantages of the diesel engine, they are awkward, expensive and space-consuming construction solutions and it has not been possible to apply these systems in present day engines.

Accordingly, one object of the present invention is to attempt to change the basis for internal combustion engines, by lowering the inherent resistance of a given engine, increasing the power of a given engine, increasing the torque generated by a given engine, producing more power and reducing the emission of non-combusted exhaust residues from a given fuel volume, providing quicker acceleration of engine revolutions, providing cleaner, cold-engine starts, reducing the amount of engine peripheral equipment and therewith save space, and enabling the invention to be applied on existing engines.

In accordance with the inventive concept, several mutually coacting functions contribute in achieving the aforesaid objects. For instance, the injection and ignition functions are embodied in an integrated unit, where the ignition function is suitably provided in a module that can be attached in the engine and the injector module, in turn, attached to the ignition module. The ignition module is suitably tubular internally, having a generally conical cavity with the open base of the cone facing inwards towards the engine combustion chamber. Fuel is sprayed under high pressure from the injector out in the apex of the cone and injection timing is adapted so that the fuel/air mixture can be ignited immediately after the fuel injector valve closes. The engine power requirement is regulated with the injector open time and with the amount of fuel delivered. When the engine idles, a minimum of primary ignited fuel is injected in from the injector and fills the top of the cone, with an air/fuel mixture optimized for ignition by the spark from the electrodes, which are positioned at a specific (optimal) distance beneath the injector in the top of the cone. The fuel may suitably be injected into the cylinder several times prior to ignition. The resistance to the injection of fuel into the cylinder is increased during the compression work of the piston, meaning that successively less fuel will be injected into the cylinder per unit of time. Injection of the primarily ignited fuel takes place in the final phase of the compression phase and the fuel pressure must exceed the compression pressure by a margin at which the overpressure impart a strong atomizing effect to the fuel and achieves a good mixture of fuel and air in the cylinder. The injector open time in combination with the fuel pressure and the cylinder compression on respective occasions causes the fuel to be injected in specific amounts on each combustion occasion and therewith the output. The flame front from the primarily ignited fuel ignites, through an accelerating flame front, any remaining fuel in the combustion chamber and in all variable cases of fuel quantity the remaining air in the cylinder is heated and generates pressure against surrounding surfaces and therewith presses the piston down in the cylinder. More effective combustion is achieved when non-combusted oxygen is delivered to the cone. This can best be achieved by the fuel injector injecting fuel and air simultaneously under high pressure.

The invention will now be described with reference to a non-limiting embodiment thereof and with reference to the accompanying drawings, in which FIG. 1 is an axial section view of an inventive injector/ignition system mounted in the cylinder head of an internal combustion engine;

Figure 1:
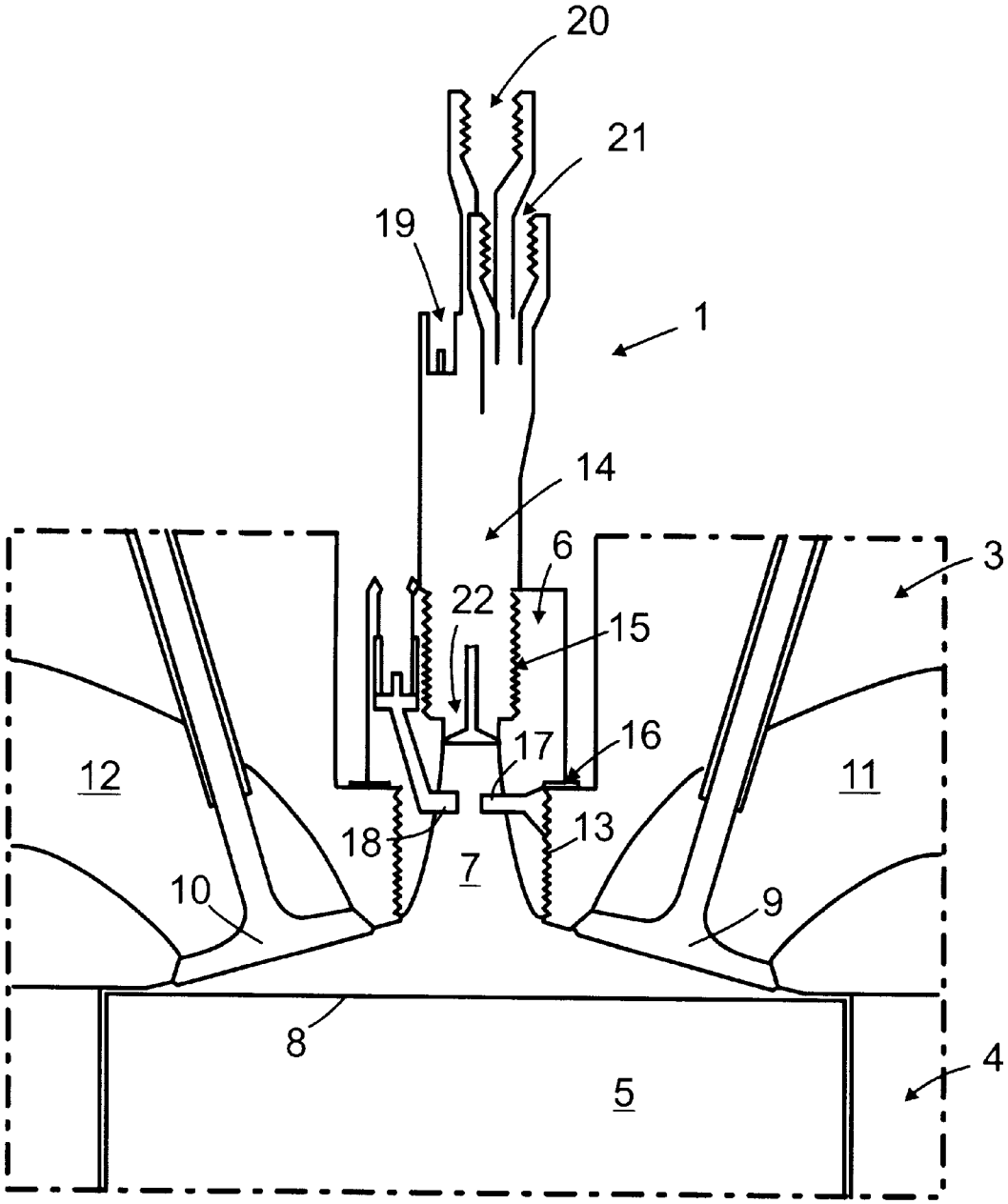

In the case of the embodiment shown in FIG. 1, the device 1 is placed centrally in the combustion chamber 2 of a conventional internal combustion engine, suitably an Otto-type engine. The cylinder head 3 of the engine is typically mounted on the engine block 4, and the Figure shows a piston 5 in its upper position. The combustion chamber is delimited in this ignition state mainly by the conical hollow cavity 7 of the ignition module 6, by the adjacent piston surface 8, by the intake valve 9, by the exhaust valve 10, and by the adjacent cylinder-head surface. Air is led to the engine combustion chamber 2 through the intake passage 11, and out through the engine exhaust passage 12. The ignition module 6 is suitably screwed to the cylinder head by a screw-thread 13. In turn, the fuel injection module 14 is screwed to the ignition module 6 by means of a screw thread 15. A seal 16 is disposed on the body of the ignition module and protects against spreading of gas pressure from the combustion chamber 2. Arranged in the conical cavity 7 of the ignition module are electrodes 17, 18 which function to ignite the fuel/air mixture in the conical cavity and in the combustion chamber. The fuel injector module 14 also includes an electric contact 19 for controlling both fuel and air flow, and with a coupling device for the supply of fuel 20 and compressed air 21, both under high pressure. The fuel/air mixture is injected into the conical cavity 7 under pressure, via a valve 22.

Figure 2:
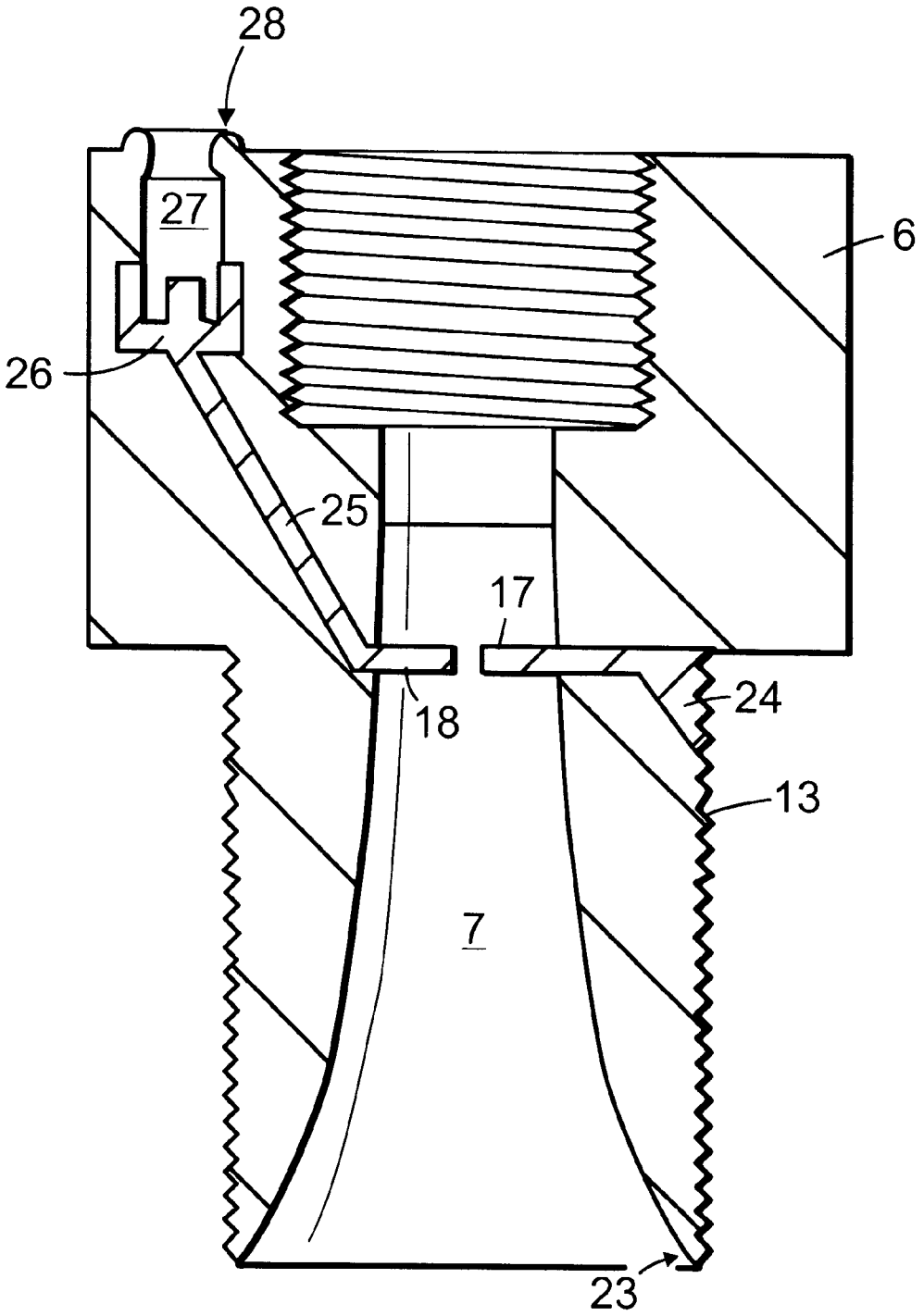
FIG. 2 illustrates the injector and the lower part of the ignition unit in larger scale.

FIG. 2 illustrates the ignition module 6 in larger scale. It will be seen from the Figure that the sides of the conical cavity 7 are not straight, but have a curved surface 23 that determines the propagation of the flame front in the combustion chamber 2 subsequent to ignition of the fuel/air mixture. One electrode 17 of the ignition module carries on the end thereof opposite from the end that projects into the cavity 7 a propagation contact 24 for connection to earth/the engine block and thereby functions as the side-electrode of the ignition module. The other electrode 18 of the ignition electrode is connected to the contact unit 26 via an electrode channel 25, said contact unit 26 receiving its ignition spark from the electronic control system of the engine. A standard ignition wire or plug lead is connected to the electric contact unit 26 by inserting the lead into a contact space 27 provided in the upper part of the ignition module 6 for connection to the electrical contact unit 26. The lead is held in said space by means of a contact-ensuring and moisture-repelling configuration 28 at the upper part of the ignition module.

Figure 3:
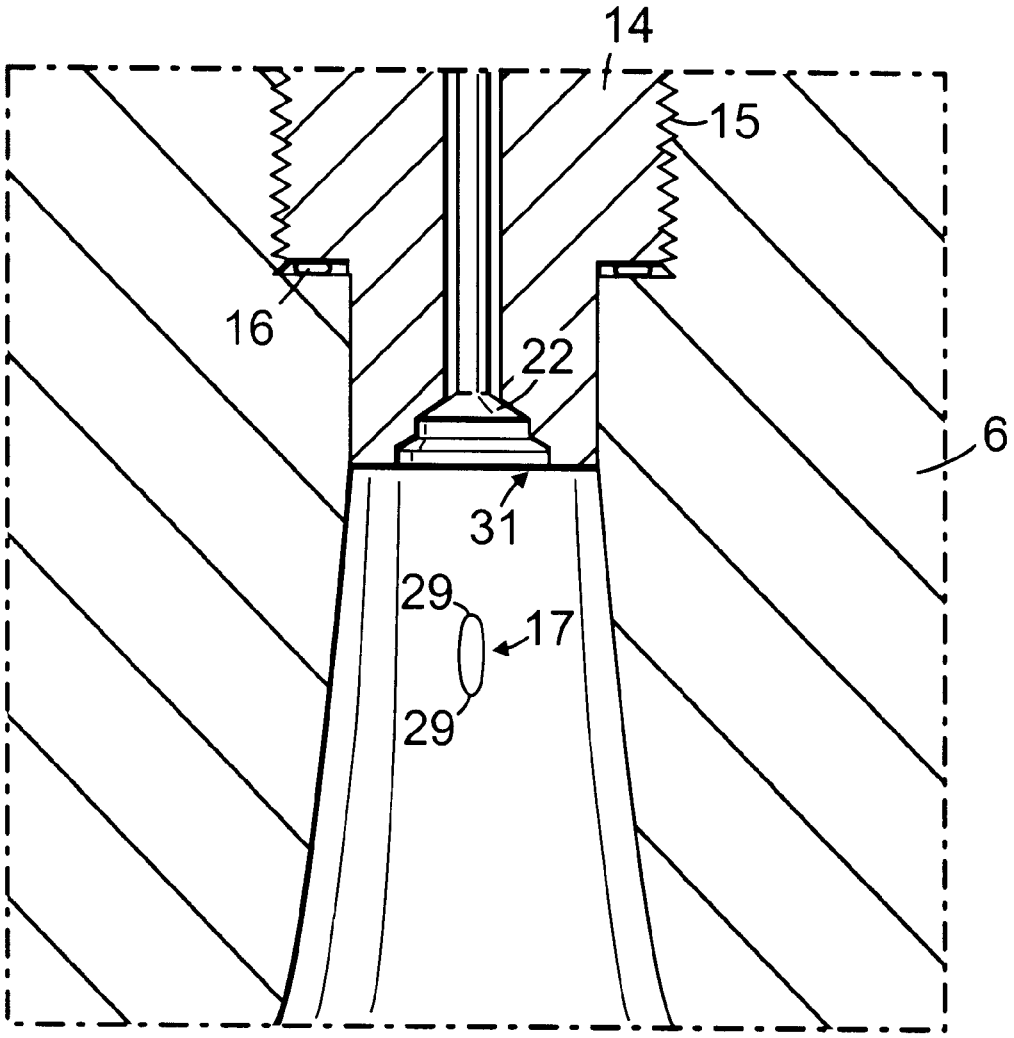
FIG. 3 illustrates the ignition unit and the injector valve system in a view that is turned through 90° in relation to the view in FIG. 2.

FIG. 3 illustrates the ignition module 6 turned through an angle of 90° in relation to FIG. 2, and also shows other components of the ignition module. FIG. 3 shows the earthed electrode 17 of the ignition module, and it will be seen from the Figure as a bevelled surface 29 on both its upper and its lower edges, so as to provide streamline shape that reduces the resistance in the fuel/air mixture as it flows into the conical cavity, and to reduce wetting of the electrode. It will also be seen from FIG. 3 that the fuel injector includes a valve 22 that lies in abutment with a valve seat 30 in the lower pant of the fuel injector module 14, and which connects with the conical cavity 7 and the combustion chamber through the medium of a stepped configuration 31. The stepped configuration downstream of the valve 22 provides better distribution of the fuel as the valve closes, and in the closing phase the last amount of fuel is pressed against the nearest step and fuel mixture is delivered to the region axially in front of the valve with the aid of the configuration of said valve. The fuel combustion pressure contributes towards guaranteeing that the valve 22 will close against the valve seat 30.

Figure 4:
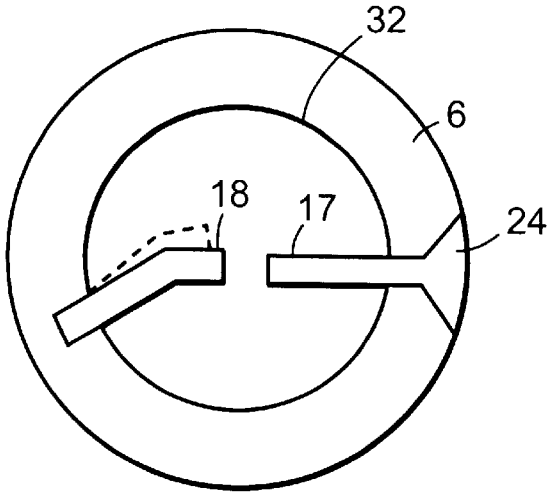
FIG. 4 illustrates the ignition module and its adjustable electrodes from above.

FIG. 4 is a cross-sectional view of the ignition module 6 and shows the propagation contact 24 of the electrode 17 against the outer periphery of the ignition module and connected to earth in the engine block. The second electrode 18 of the ignition module is flexibly adjustable, as shown by the broken lines, so as to enable the electrode spacing to be adjusted. It will also be seen from FIG. 4 that the inner wall 32 of the conical cavity is generally circular.

Figure 5:
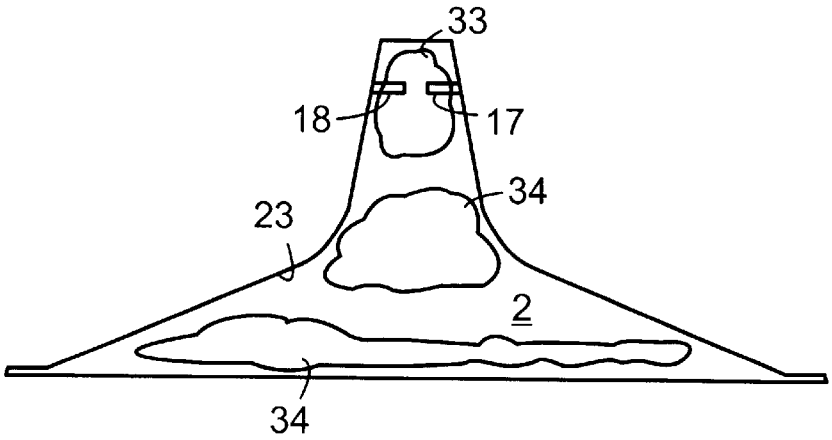
FIG. 5 illustrates schematically several clouds of fuel/air mixture in the combustion chamber on an internal combustion engine.

FIG. 5 shows several clouds of fuel/air mixture in the conical cavity 7 and in remaining parts of the combustion chamber 2. FIG. 5 also shows the electrodes 17, 18 in the conical cavity. This view shows the state immediately prior to the electrodes igniting the primary ignited fuel 33 in the conical cavity 7, this fuel thereafter also igniting secondary ignited fuel 34 in the combustion chamber 2 in applicable cases. The fuel may consist of very lean fuel/air mixtures. Because the base of the conical cavity has a determined radius, the flame front will be propagated very effectively when the fuel is ignited.

Figure 6:
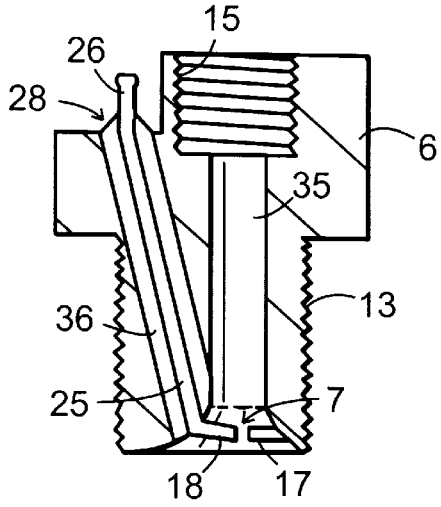
FIG. 6 illustrates another embodiment of the ignition module shown in FIG. 1.

The ignition module 6 shown in FIG. 6 fulfils the same function as that shown in FIG. 1 and also includes a screw-thread 13 for screwing the module onto an engine block, not shown. The ignition module of this embodiment also has an internal screw thread 15 for receiving a fuel injector module (not shown) that may have substantially the same appearance as that shown in FIG. 1, although with the difference that in this case the fuel injector module must have an extension that fits into the tubular extension 35 of the ignition module and terminates close to the conical cavity 7 in the upper edge of the actual combustion chamber. In this case, the side-electrode 17 is mounted directly in the ignition module 6, and the main electrode 18 extends in its electrode channel 25 up to the contact unit 26. The main electrode 18 is surrounded by insulation 36 in the ignition module 6. The electrical contact unit 26 of this embodiment also has a moisture-repelling configuration 28 at the upper edge of the ignition module 6.

Figure 7:
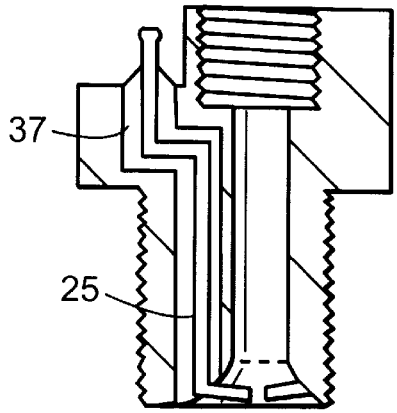
FIG. 7 illustrates another embodiment of the ignition module shown in FIG. 1.

The ignition module illustrated in FIG. 7 differs from the module illustrated in FIG. 6 primarily by a different orientation of the electrode channel 25 such as to improve resistance against combustion pressure, and an insulation 37 which, in this case, must be stronger than the insulation in the FIG. 6 embodiment.

Figure 8:
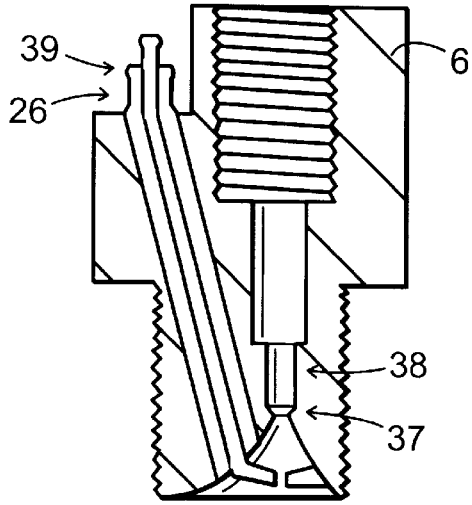
FIG. 8 illustrates yet another variant of the ignition module shown in FIG. 1.

The ignition module 2 illustrated in FIG. 8 differs from the ignition modules illustrated in FIGS. 6 and 7 mainly by a strengthened ignition module body and a different configuration of the tubular extension 35 of the ignition module, this extension being more adapted to a configuration of the injector module where said module has an outwardly projecting valve-part with a valve seat located at 37 and the valve needle of the injector accommodated in the space 38. The design of the electrical contact unit 26 is also slightly different to the unit of the embodiments shown in FIGS. 1, 6 and 7, so as to facilitate connection of the ignition wire or plug lead, and the insulation 36 has been drawn-up to an enlarged raised portion 39.

An ignition module that is constructed in accordance with the invention provides a unit with which the injector module can be easily unscrewed from the ignition module in the same way as the actual body of the ignition module can be unscrewed from the cylinder head of the engine. Units that can be readily and economically replaced when necessary are obtained in this way. The ignition module body can be mounted in the engine block and the injector module can be mounted in the injector module body in other ways, for instance clamped or bolted thereto.

The ignition module may be made entirely or partially from a heat-resistant and electrically-insulating material, such as a ceramic material, for instance. This gives a small heat-absorbing surface in the conical cavity in which primary combustion takes place, therewith leading to reduced heat losses, particularly at lower power outputs, since the main combustion will then still take place in the conical cavity. However, the ignition module may be alternatively made entirely of metal, so as to simplify manufacture and provide greater durability. However, the conical cavity 7 of the ignition module 6 and the delimiting surfaces of said cavity can conceivably be comprised of a separate insert that is made entirely or partially of electrical and heat-insulating material.

The inventive ignition module also provides the advantage of heating the fuel in the injector module and in the small conical cavity, therewith enabling the fuel to be more readily ignited by a spark. In addition, when the base of the conical cavity forms a rounding towards the delimiting surfaces of the combustion chamber, the flame front will be propagated more effectively in the combustion chamber and therewith provide more effective and more complete combustion of the fuel in said combustion chamber.

The positioning of the electrodes in the ignition module is also significant to the effectiveness of the ignition module. The electrodes will preferably be placed at an appropriate distance downstream of the fuel valve of the injector module, and optimal positioning of the electrodes will preferably be made with respect to the fuel requirement of the engine when idling. The construction in which the fuel is ignited in the vicinity of the injector means that the electrodes will be cooled effectively by the injected fuel to a correct working temperature, therewith avoiding overheating. The spark gap may be finely adjusted by bending the electrodes. The electrodes may be cleaned and/or heated with extra sparks prior to starting, and optionally also while the engine is running, during the period in which the combustion chamber is empty of fuel.

General engine characteristics that contribute to the effectiveness of the invention include:

The absence of an air throttle provides a large air surplus at all engine speeds.

A low internal resistance in the engine in the absence of a vacuum results in low fuel consumption when idling and at low power outputs.

Rapid throttle response, since intake and cylinder are continuously filled with air. The cylinder may also be "overcharged" with turbo/compressor or the like. This results in extremely rapid throttle response from an engine idling state, and other advantages are amplified by the omission of the air throttle.

More air takes excess heat from the cylinder. Heat losses to the cylinder walls and other heat-absorbing surfaces are reduced. The maximum amount of air is sucked or pressed into the cylinder, is heated by the cylinder walls, expands and delivers more power from a given quantity of fuel. This results in a more effective engine for a given amount of fuel.

High torque and power at low engine speeds.

The engine runs cooler. This results in less risk of engine damage.

Cleaner exhaust gases are generated, because large quantities of free oxygen can react with primary combusted exhaust gases already in the cylinder—a form of built-in EGR. These quantities of free oxygen can react with fuel residues in the cylinder, all the way out of the engine, through the intake and exhaust manifold, the turbo, the exhaust pipe and catalyst and the remaining hot parts of the engine exhaust system.

The more air that is sucked or pressed into the cylinder prior to combustion, the cleaner the combustion residues. Hydro carbons, carbon oxides and nitrogen oxides are emitted to a correspondingly lesser extent.

With the aid of modem engine electronics, the inventive device can be controlled so that the amount of injected fuel is separated linearly from the amount of air consumed.

The following results are obtained with the local primary combustion in accordance with the invention:

Sooting is drastically decreased, particularly in the case of cold engine starts when an additionally heavy fuel/air mixture is required for ignition. The present invention enables the mixture to be placed and ignited locally.

Positive combustion with good control over the ignition range of the fuel/air mixture results in less risk of ignition failure and therewith in less engine wear.

High compression is possible. The amount of fuel can be finely adjusted in quantity and positioning in the combustion chamber, which reduces the risk of spiking.

Other fuels can supplement the primary combustion. For instance, gas, alcohol, diesel, kerosene or some less ignitable fuel can be used. Supplementary fuel can be sucked in through the intake valve together with other air, and ignited by the primary combustion.

In view of the absence of gas throttle and indicators for indicating air quantity, air temperature, humidity, air density, EGR devices, air pumps, and so on, the engine construction will be much simpler. The entire device can be accommodated in the space occupied by the spark plugs of present-day engines.

Existing engines, in motor vehicles and boats among others, can be provided with the present invention. The construction can be placed in existing space for spark plugs with which all petrol-driven engines are provided, both carburetor engines and injection engines and irrespective of the number of valves.

Although the invention has been described with reference to a number of different embodiments thereof, it will be understood that different solutions in the different examples can be combined arbitrarily with one another, and that other known detailed solutions in internal combustion engines can be combined with the invention without departing from the inventive concept.

I claim:

1. A device for integrated injection and ignition in an internal combustion engine, characterized in that the device includes an integrated injection module (14) and ignition module (6), in that the ignition module includes a body fastenable to the top of the engine and which has an internal tubular shape whose lower part merges with a conical cavity (7) whose base is open to the engine combustion chamber (2) such that the conically shaped cavity (7) forms a supplementary smaller volume of the combustion chamber.

2. A device according to claim 1, characterized in that the ignition module (6) has an external screw thread (13) which can be screwed into a corresponding screw thread in the top of the engine.

3. A device according to claim 1, characterized in that the conical cavity is defined by a wall about an axial line and the wall of the conical cavity (7) defines an angle of at most 25° with the axial line.

4. A device according to claim 1, characterized in that the supplementing smaller volume formed by the conical cavity (7) reaches at most one-fourth of the total volume of the combustion chamber.

5. A device according to claim 1, characterized in that the end of the conical cavity (7) adjacent the combustion chamber has a rounded connection (23), the radius of which is between 3 and 30 mm.

6. A device according to claim 1, characterized in that the ignition module (6) includes at least two electrodes (17, 18), of which one electrode (17) is connected to engine/earth by a propagation contact (24), and at least one electrode (18) is insulated from earth and connected to an electrical contact unit (26) for further connection to a high voltage source.

7. A device according to claim 6, characterized in that the electrodes (17, 18) are mounted in the ignition module (6) so as to be located in the conical cavity (7).

8. A device according to claim 7, characterized in that the electrodes (17, 18) are bevelled (29) to a streamline shape at their respective upper and lower edges.

9. A device according to claim 6, characterized in that the electrode (18) insulated from earth is connected to the electrical contact unit (26) via an insulated (36) electrode channel (25) that passes through the body of the ignition module (6).

10. A device according to claim 1, characterized in that the injection module (14) includes an external screw thread (15) for screwing the injection module to the ignition module (6).

11. A device according to claim 10, characterized in that the injection module (14) includes a valve (22) which closes against a valve seat (30) for closing against the combustion chamber (2), wherewith the valve seat (30) has a stepped configuration (31) adjacent the conical cavity.

* * * * *